US011454363B2

(12) United States Patent
Chen et al.

(10) Patent No.: US 11,454,363 B2
(45) Date of Patent: Sep. 27, 2022

(54) ILLUMINATION DEVICE AND VEHICLE LAMP

(71) Applicant: YLX Incorporated, Shenzhen (CN)

(72) Inventors: Bin Chen, Shenzhen (CN); Xianpeng Zhang, Shenzhen (CN); Yi Li, Shenzhen (CN)

(73) Assignee: YLX Incorporated, Shenzhen (CN)

( * ) Notice: Subject to any disclaimer, the term of this patent is extended or adjusted under 35 U.S.C. 154(b) by 0 days.

(21) Appl. No.: 17/275,058

(22) PCT Filed: May 15, 2019

(86) PCT No.: PCT/CN2019/086927
§ 371 (c)(1),
(2) Date: Mar. 10, 2021

(87) PCT Pub. No.: WO2020/052253
PCT Pub. Date: Mar. 19, 2020

(65) Prior Publication Data

US 2022/0057063 A1 Feb. 24, 2022

(30) Foreign Application Priority Data

Sep. 10, 2018 (CN) ..... 201811053154.1

(51) Int. Cl.
*F21S 41/176* (2018.01)
*F21S 41/24* (2018.01)
(Continued)

(52) U.S. Cl.
CPC ..... *F21S 41/176* (2018.01); *F21S 41/141* (2018.01); *F21S 41/24* (2018.01); *F21S 41/32* (2018.01); *F21S 45/47* (2018.01)

(58) Field of Classification Search
CPC ..... F21S 41/176; F21S 41/24
See application file for complete search history.

(56) References Cited

U.S. PATENT DOCUMENTS 9,885,813 B2 * 2/2018 Yamanaka ..... F21S 41/285
11,157,715 B2 * 10/2021 Huang ..... G06K 9/00046
(Continued)

FOREIGN PATENT DOCUMENTS

CN 1425117 6/2003
CN 101641623 2/2010
(Continued)

OTHER PUBLICATIONS

International Search Report for International Application PCT/CN2019/086927, dated Aug. 21, 2019.
(Continued)

*Primary Examiner* — Matthew J. Peerce
(74) *Attorney, Agent, or Firm* — Burris Law, PLLC

(57) ABSTRACT

An illumination device includes a light source and a light guide including a first light guide portion and a second light guide portion. The second light guide portion contains a light-emitting face, and the excitation light emitted by the light source is coupled and enters the first light guide portion and is emitted via the light-emitting face of the second light guide portion. The area of the cross section, perpendicular to a light guide central line, of the second light guide portion is gradually decreased in the direction of an optical axis of the light source. An angle between an intersecting line of the light-emitting face of the second light guide portion and the cross section passing through the light guide central line or any tangent line of the intersecting line and the light guide central line is an acute angle.

16 Claims, 4 Drawing Sheets

(51) Int. Cl.

| | |
|---|---|
| ***F21S 41/141*** | (2018.01) |
| ***F21S 45/47*** | (2018.01) |
| ***F21S 41/32*** | (2018.01) |

(56) References Cited

U.S. PATENT DOCUMENTS

| | | | | |
|---|---|---|---|---|
| 2008/0192458 | A1 | 8/2008 | Li | |
| 2012/0075733 | A1 | 3/2012 | Yamada et al. | |
| 2012/0139409 | A1 | 6/2012 | Kishimoto et al. | |
| 2015/0009705 | A1* | 1/2015 | Tsuchiya | F21K 9/61 362/558 |
| 2015/0085464 | A1 | 3/2015 | Suzuki | |

FOREIGN PATENT DOCUMENTS

| | | |
|---|---|---|
| CN | 204045629 | 12/2014 |
| CN | 205592695 | 9/2016 |
| EP | 2378323 | 10/2011 |
| JP | 2003515899 | 5/2003 |
| JP | 2015011976 | 1/2015 |

OTHER PUBLICATIONS

First Office Action issued in corresponding CN application 201811053154.1, dated Oct. 28, 2021, and an English translation, 13 pages.

* cited by examiner

ILLUMINATION DEVICE AND VEHICLE LAMP

CROSS-REFERENCE TO RELATED APPLICATIONS

This application is a national phase of International Application No. PCT/CN2019/086927, filed on May 15, 2019, which claims priority to and the benefit of Chinese Application Number 201811053154.1, filed on Sep. 10, 2018. The disclosures of the above applications are incorporated herein by reference.

FIELD

The present disclosure relates to the field of illumination technology and, in particular, to an illumination device and a vehicle lamp.

BACKGROUND

The statements in this section merely provide background information related to the present disclosure and may not constitute prior art.

Lamps on vehicles are an important factor that affects driving safety of vehicles, and development of the vehicle industry puts forward higher and higher requirements for vehicle lamps.

Tungsten filament lamps are commonly used light sources for automotive illumination, and because of their low luminous brightness, high energy consumption, and insufficient life span, they are gradually eliminated. To improve brightness of the light source and reduce energy consumption, researchers began to develop a laser illumination device that simulates filament applications as an illumination source. It is formed by coupling excitation light emitted by the laser light source into a rod-shaped light-guiding element and then being emitted from a surface of the rod-shaped light-guiding element. The simulated filament has the same luminous characteristics as the filament of the tungsten filament lamps, and it has advantages such as high brightness and long life, so it can replace the tungsten filament lamp in the automotive illumination field.

To meet heat dissipation requirements of the laser light source, materials having a high thermal conductivity, such as $Al_2O_3$ single crystal or YAG single crystal, are preferably used when preparing the illumination device. Due to a high refractive index of the $Al_2O_3$ single crystal or YAG single crystal, a total internal reflection angle at its interface is relatively small. When light rays are transmitted to a light emitting end of the illumination device, only fewer light rays that do not meet the total internal reflection angle are emitted to outside through the light emitting end to achieve illumination, however, more light rays satisfying the total internal reflection angle cannot be directly emitted from the light emitting end to the outside, and this results in multiple total internal reflections of a light beam inside the illumination device, which increases a thermal effect of the illumination device on the one hand, and on the other hand leads to a low light utilization rate.

SUMMARY

This section provides a general summary of the disclosure and is not a comprehensive disclosure of its full scope or all of its features.

In one form, the present disclosure provides an illumination device that improves light utilization rate. The illumination device includes: a light source configured to emit excitation light; and a light guide including a first light guiding portion and a second light guiding portion, where the second light guiding portion includes a light emitting surface, the excitation light emitted by the light source is coupled into the first light guiding portion and then emitted through the light emitting surface of the second light guiding portion, a cross section of the second light guiding portion perpendicular to a center line of the light guide has an area gradually decreasing along a direction of an optical axis of the light source, and an intersecting line of the light emitting surface of the second light guiding portion and the cross section passing through the center line of the light guide or each of tangent lines of the intersecting line forms an acute angle with the center line of the light guide.

The illumination device of the present disclosure can reduce the incidence angle at which the excitation light coupled into the light guide is incident to the light emitting surface of the second light guiding portion, thereby reducing the total internal reflection of the excitation light on the light emitting surface of the second light guiding portion, to improve the light emission efficiency and to further improve the light utilization rate.

In some variations, the intersecting line of the light emitting surface of the second light guiding portion and the cross section passing through the center line of the light guide or each of the tangent lines of the intersecting line forms an angle smaller than 45 degrees with the center line of the light guide. Accordingly, the illumination device of the present disclosure can not only improve the light emission efficiency of the excitation light, but also increase a proportion of light on a side of the illumination device, so that the emitted light can be more effectively used, and the light utilization rate is further improved.

In some variations, the illumination device further includes a functional layer coated on the light emitting surface of the second light guiding portion and configured to perform a wavelength conversion on the excitation light or scatter the excitation light, to form illumination light.

In some variations, the second light guiding portion of the light guide is a cone, and the intersecting line of the side surface of the second light guiding portion and the cross section passing through the center line of the light guide forms an angle smaller than 45 degrees with the center line of the light guide.

In some variations, the second light guiding portion of the light guide is a truncated cone, and the intersecting line of the side surface of the second light guiding portion and the cross section passing through the center line of the light guide forms an angle smaller than 45 degrees with the center line of the light guide, and a second end surface of the truncated cone facing away from the first light guiding portion is a flat surface or a groove, a reflective layer is arranged on the flat surface or in the groove, and the reflective layer can be a diffusing reflective layer or a Gaussian scattering reflective layer. Accordingly, the illumination device of the present disclosure can make the excitation light irradiated to the flat surface or the groove be irradiated to the functional layer after being reflected by the reflective layer, thereby improving the light efficiency.

In some variations, a side surface of the second light guiding portion is a curved surface, and any straight line tangent to the intersecting line of the side surface of the second light guiding portion and the cross section passing through the center line of the light guide forms an angle smaller than 45 degrees with the center line of the light guide.

In some variations, the light guide further includes: a heat dissipation layer disposed on a side surface of the first light guiding portion and configured to dissipate heat of the light guide; and a transparent adhesive layer configured to bond the heat dissipation layer to a side surface of the first light guiding portion in such a manner that the heat of the light guide is conducted to the heat dissipation layer, where a refractive index of the transparent adhesive layer is smaller than a refractive index of an light incident end. Accordingly, the illumination device of the present disclosure can improve a heat dissipation performance of the light guide by providing the heat dissipation layer, and at the same time, it can provide that the excitation light is still totally internally reflected on the side surface of the light incidence end, to maintain a relatively high light utilization rate.

In another form, the present disclosure is directed to a vehicle lamp. The vehicle lamp includes the above-mentioned illumination device.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
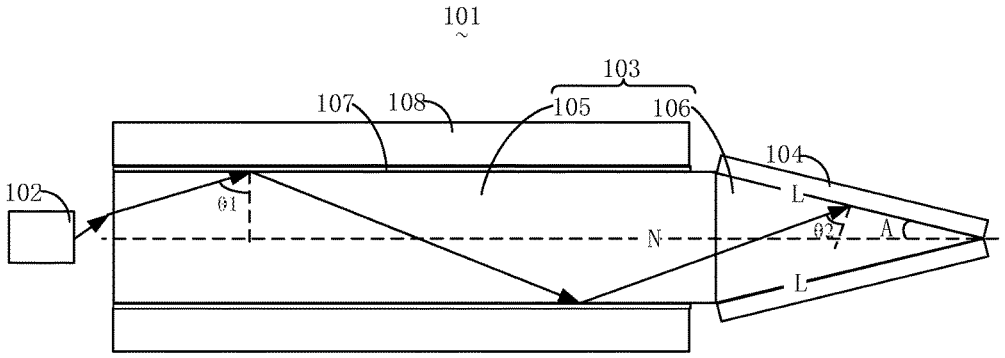
FIG. 1 is a schematic diagram of an illumination device according to a first form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Beneficial effects of the present disclosure lie in that: different from the related art, the illumination device of the various forms of the present disclosure includes a light source and a light guide, wherein the light source is configured to emit excitation light; the light guide includes a first light guiding portion and a second light guiding portion, where the second light guiding portion includes a light emitting surface, the excitation light emitted by the light source is coupled into the first light guiding portion and then emitted through the light emitting surface of the second light guiding portion, a cross section of the second light guiding portion perpendicular to a center line of the light guide has an area gradually decreasing along a direction of an optical axis of the light source, and an intersecting line of the light emitting surface of the second light guiding portion and the cross section passing through the center line of the light guide or each of tangent lines of the intersecting line forms an acute angle with the center line of the light guide. In this way, an incidence angle at which the excitation light coupled into the light guide is incident to the light emitting surface of the second light guiding portion can be reduced, the total internal reflection of the excitation light on the light emitting surface of the second light guiding portion is reduced, the light emission efficiency is improved, and the light utilization rate is improved.

FIG. 1 is a schematic diagram of an illumination device according to a first form of the present disclosure. The illumination device 101 of this form includes a light source 102, a light guide 103 and a functional layer 104. The light source 102 is configured to emit excitation light, and the light source 102 is a semiconductor light source such as a laser or an LED. The light guide 103 includes a first light guiding portion 105 and a second light guiding portion 106, the first light guiding portion 105 has a columnar structure including two bottom surfaces and a cylindrical surface, preferably a cylindrical structure. The second light guiding portion 106 is a pyramidal structure including a bottom surface and a pyramidal surface, the conical surface is a light emitting surface, and the pyramidal structure is preferably a cone structure, an area of the bottom surface of the first light guiding portion 105 is equal to an area of the bottom surface of the second light guiding portion 106, which realizes connection between the first light guiding portion 105 and the second light guiding portion 106. The excitation light emitted by the light source 102 is coupled into the light guide 103 from one bottom surface of the first light guiding portion 105 and enters the second light guiding portion 106 from the other bottom surface of the first light guiding portion 105. The functional layer 104 is disposed on the light emitting surface of the second light guiding portion 106 and configured to perform a wavelength conversion on or scatter the excitation light entering the second light guiding portion 106, an a cross section (not shown in the drawing) of the second light guiding portion 106 perpendicular to a center line N of the light guide has an area gradually decreasing along an optical axis direction of the light source, and an intersecting line L of the light emitting surface of the second light guiding portion 106 and the cross section passing through the center line N of the light guide forms an angle A with the center line N of the light guide, preferably the angle A is smaller than 45 degrees. A proportion of light on a side of the illumination device 101 increases as the angle A decreases, so that the emitted light can be utilized more effectively, and a light utilization rate can be improved.

The light source 102 of this form is a laser light source, and using the laser light source can increase brightness of the light source coupled into the light guide 103, to further improve brightness of the illumination device 101. Without doubt, in other variations, other semiconductor light sources such as an LED can also be used as the light source 102.

The material of the light guide 103 of this form can be a material with a high thermal conductivity such as $Al_2O_3$ single crystal or YAG single crystal, which can improve a thermal performance of the light guide 103.

The first light guiding portion 105 of the light guide 103 of this form further includes a transparent adhesive layer 107 and a heat dissipation layer 108. The heat dissipation layer 108 is provided on an outer surface of the first light guiding portion 105 and configured to dissipate heat of the light guide 103. The transparent adhesive layer 107 is configured to bond the first light guiding portion 105 and the heat dissipation layer 108, so that the heat of the first light guiding portion 105 is conducted to the heat dissipation layer 108, and a refractive index of the transparent adhesive layer 107 is smaller than a refractive index of the first light guiding portion 105, so that the excitation light can be totally internally reflected at the columnar surface of the first light guiding portion 105, thereby reducing light loss.

The first light guiding portion 105 and the second light guiding portion 106 of this form are formed into one piece. Without doubt, in other variations, the first light guiding portion 105 and the second light guiding portion 106 can also be formed separately and then connected into one piece.

The light emitting surface of the second light guiding portion 106 of this form is provided with a functional layer 104, the functional layer 104 is a wavelength conversion layer or a scattering layer, to further perform wavelength conversion on the incident excitation light or scatter the incident excitation light, and the wavelength conversion layer contains fluorescent materials that can be excited to generate yellow light, however, in other variations, the wavelength conversion layer can also be fluorescent materials that can be excited to generate other colors. The wavelength conversion layer is a mixture of the fluorescent material and glass or silica gel. Without doubt, in other variations, the functional layer can also be a scattering layer, for example, the functional layer can be a mixture of scattering particles and glass or silica gel. The scattering layer is configured to scatter the excitation light emitted from the light emitting surface of the second light guiding portion of the light guide, and further the scattering particles are $Al_2O_3$, $BaSO_4$, MgO, $TiO_2$, etc. Furthermore, the light emitting surface of the second light guiding portion 106 is a frosted surface, which reduces the total internal reflection of the excitation light.

When providing the functional layer 104, the functional layer 104 can be pre-coated on the light emitting surface of the second light guiding portion 106, and then the functional layer 104 is adhered to the light emitting surface of the second light guiding portion 106 through processes such as high-temperature curing or high-temperature sintering. Without doubt, in another variations, the functional layer 104 can also be formed separately and then bonded to the light emitting surface of the second light guiding portion 106.

Different from the existing art, the intersecting line L of the light emitting surface of the second light guiding portion 106 and the cross section passing through the center line N of the light guide forms an acute angle with the center line N of the light guide, preferably the acute angle is smaller than 45 degrees. Such design can reduce an incidence angle of the excitation light incident on the light emitting surface of the second light guiding portion 106, which reduces the total internal reflection of the excitation light on an interface between the light emitting surface and the functional layer 104, such that more excitation light is emitted to the functional layer 104 to achieve wavelength conversion or scattering, to further improve the utilization rate of the excitation light of the illumination device. In addition, since the total internal reflection of the excitation light is reduced, an optical path of the excitation light in the light guide is reduced, so the thermal effect of the excitation light inside the light guide 103 is reduced.

In an application scenario, the propagation of the optical path of the excitation light is shown in FIG. 1, the material of the light guide 103 is $Al_2O_3$ single crystal having a refractive index of about 1.77, the refractive index of the transparent adhesive layer 107 is about 1.43, so a critical angle at which the excitation light can be totally internally reflected at the interface between the first light guiding portion 105 of the light guide 103 and the transparent adhesive layer 107 is about 53.9 degrees (the critical angle of total internal reflection=arcsin(n1/n2), where n1 is a refractive index of an optically dense medium, and n2 is a refractive index of an optically thin medium); a beam divergence half-angle of the excitation light of the light source 102 is about 25 degrees, an incidence angle θ1 of the incidence light of the excitation light on a side surface of the first light guiding portion 105 is about 76 degrees, obviously, the incidence angle θ1 is greater than the critical angle of total internal reflection, so the excitation light is totally internally reflected on the columnar surface of the first light guiding portion 105; the functional layer 104 is a glass-based wavelength conversion layer having a refractive index of about 1.6, therefore, the critical angle at which the excitation light can be totally internally reflected at the interface between the light emitting surface and the functional layer 104 is about 64.7 degrees; the incidence angle of the excitation light incident on the light emitting surface is 02=01-A, A is about 15 degrees, so 02 is about 61.2 degrees, obviously, the incidence angle θ2 is smaller than the critical angle of total internal reflection, therefore, the excitation light can be emitted to the functional layer 104 and be absorbed by the phosphor to be converted into fluorescence.

Without doubt, in other variations, the light guide 103 of the illumination device can also have other shapes and other sizes, and the light guide, the functional layer, and the transparent adhesive layer, etc. of the illumination device can also be made of materials having other refractive index, and the incidence angle of the excitation light in the illumination device can also be changed adaptively.

Figure 2:
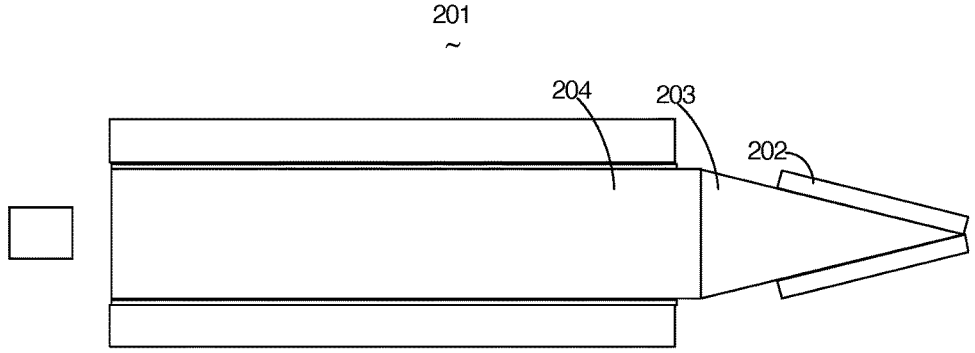
FIG. 2 is a schematic diagram of an illumination device according to a second form of the present disclosure.

The present disclosure further proposes an illumination device in a second form, as shown in FIG. 2, FIG. 2 is a schematic diagram of the illumination device according to the second form of the present disclosure. A difference between the illumination device 201 of this form and the illumination device 101 of the foregoing form lies in that the functional layer 202 of the illumination device 201 of this form is coated on the light emitting surface of a side surface of a cone 203, and an area of the functional layer 202 is smaller than an area of the side surface, in other words, the functional layer 202 is only coated on a part of the side surface of the cone 203, that is, the area of the light emitting surface is smaller than the area of the side surface. Specifically, the functional layer 202 is coated on an end of the side surface of the cone 203 facing away from the first light guiding portion 204.

The side surface not coated by the functional layer 202 is to be polished, so that the excitation light can be totally internally reflected on the polished side surface, to reduce light loss. In this way, a volume of the cone formed by the light emitting surface is smaller, and the flexibility of the optical design is improved.

Without doubt, the coating area of the functional layer 202 on the conical surface can be set according to the light-emitting area required by the illumination device 201.

Figure 3:
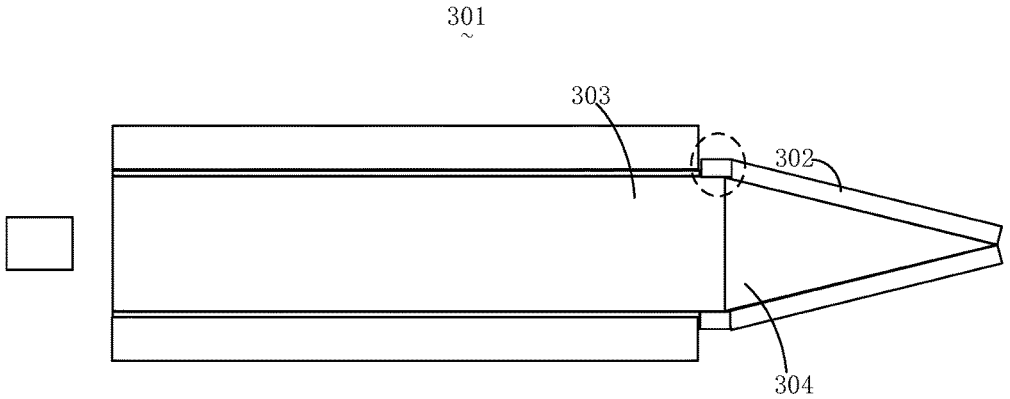
FIG. 3 is a schematic diagram of an illumination device according to a third form of the present disclosure.

The present disclosure provides an illumination device according to a third form, as shown in FIG. 3, FIG. 3 is a schematic diagram of the illumination device according to the third form of the present disclosure. A difference between the illumination device 301 of this form and the illumination device 101 of the foregoing form lies in that the functional layer 302 of this form is further coated on the light emitting surface of the side surface of the first light guiding portion 303. Specifically, the functional layer 302 is further coated on an end of the side surface of the first light guiding portion 303 close to the second light guiding portion 304 (shown by a dotted circle in the drawing). In this way, the functional layer 302 can convert the excitation light emitted from an interface between the first light guiding portion 303 and the second light guiding portion 304 into fluorescence, to improve the light utilization efficiency and light efficiency. A length of the functional layer 302 that is coated on the first light guiding portion 303 can be within a range of 0.2 mm to 1.0 mm. Without doubt, in other variations, the length can be set according to specific requirements.

Figure 4:
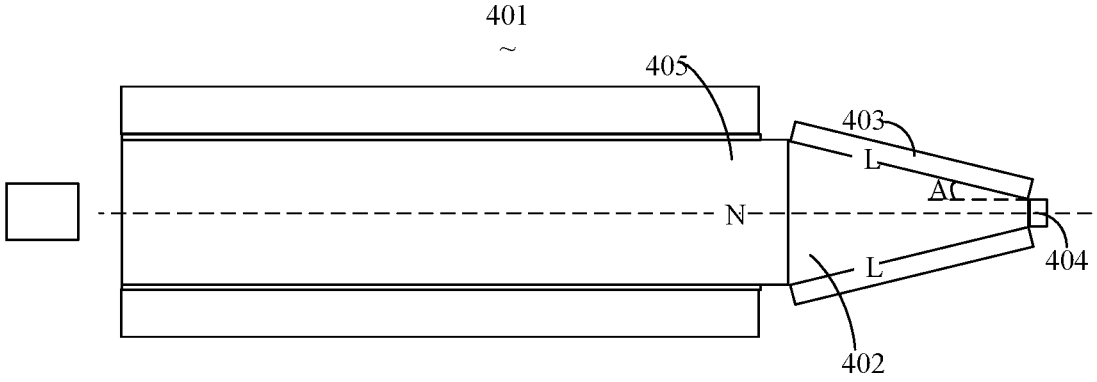
FIG. 4 is a schematic diagram of an illumination device according to a fourth form of the present disclosure.

The present disclosure further proposes an illumination device of a fourth form, as shown in FIG. 4, FIG. 4 is a schematic diagram of the illumination device according to the fourth form of the present disclosure. A difference between the illumination device 401 of this form and the above-mentioned illumination device 101 lies in that the second light guiding portion 402 of this embodiment is a truncated cone 402, the intersecting line L of the side surface of the truncated cone 402 and the cross section passing through the center line of the light guide (not shown in the drawing) forms an angle A with the center line N of the light guide, preferably the angle A is smaller than 45 degrees, and the functional layer 403 is coated on the light emitting surface of the side surface of the truncated cone 402.

Optionally, the illumination device 401 of this form further includes a reflective layer 404, a first end surface of the truncated cone 402 is connected to the first light guiding portion 405, the reflective layer 404 is disposed on a second end surface of the truncated cone 402, and the first end surface and the second end surface of the truncated cone 402 are arranged opposite to each other.

In this form, the reflective layer 404 is provided on the second end surface of the truncated cone 402, which can reflect the excitation light emitted from the second end surface of the truncated cone 402 back to the light guide, to improve the light efficiency.

The reflective layer 404 can be provided as a diffusing reflective layer or a Gaussian scattering reflective layer, the diffusing reflection indicates that a light beam has a Lambertian distribution after being reflected by the reflective layer, and light intensity of reflected light thereof has a cosine distribution, and a material for the diffusing reflection can be a mixture of particles such as $TiO_2$, MgO, $BaSO_4$ and glue or glass powder, and the mixture is pasted on the second end surface of the truncated cone 402 through a high-temperature curing or sintering process. The Gaussian scattering reflection indicates that a light beam has a Gaussian distribution after being reflected by the reflective layer, and the light intensity of the reflected light thereof has a Gaussian distribution, and the Gaussian scattering reflective layer can be formed by sintering silver powders on the second end surface of the truncated cone 402.

Figure 5:
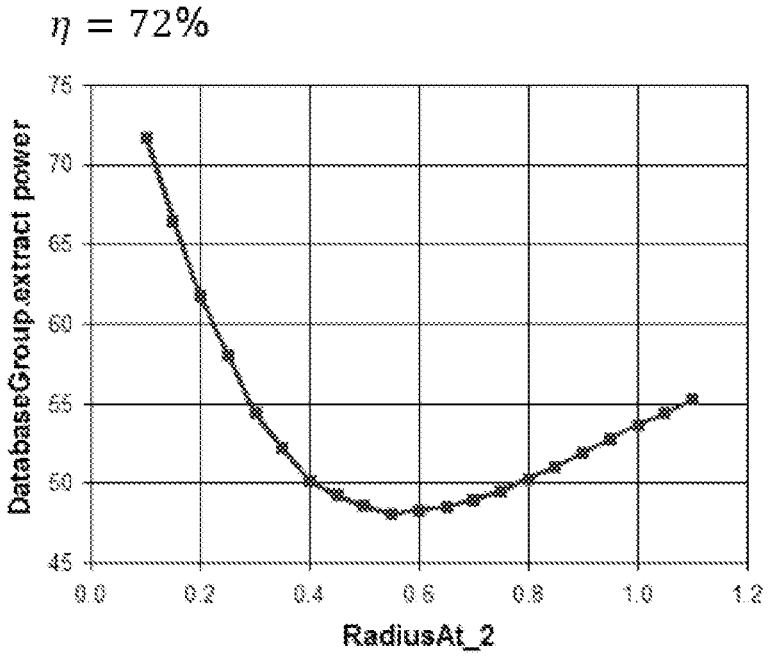
FIG. 5 is a schematic diagram of simulation results of a light utilization rate of an illumination device depicted in the form of FIG. 4.

Further, a radius of the first end surface of the second light guiding portion 405 of this form is about 1.1 mm, and a length of the second light guiding portion 402 is about 6 mm. It is assumed that a radius of the second end surface of the second light guiding portion is R, the reflective layer 404 thereof has a Lambertian diffusing reflection, and a relationship between a light emission efficiency n of the excitation light transmitted to the functional layer and R is shown in FIG. 5, it can be seen from FIG. 5 that the light emission efficiency n first decreases sharply and then slowly increases as the radius R of the second end surface increases, and when R is 0.1 mm, the light emission efficiency is 72%.

Figure 6:
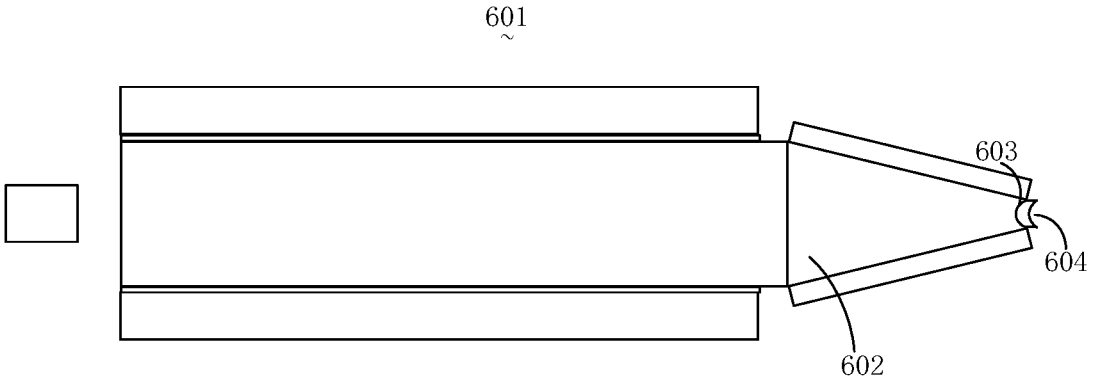
FIG. 6 is a schematic diagram of an illumination device according to a fifth form of the present disclosure.

The present disclosure further proposes an illumination device of a fifth form, as shown in FIG. 6, FIG. 6 is a schematic diagram of the illumination device according to the fifth form of the present disclosure. A difference between the illumination device 601 in this form and the above-mentioned illumination device 401 lies in that the second end surface of the truncated cone 602 in this form is provided with a groove 603, and the reflective layer 603 is arranged in the groove 603. The reflective layer 603 can be a diffusing reflective layer or a Gaussian reflective layer. Since the reflective layer 604 is a curved surface, angles of light rays changes greatly after being reflected by the reflective layer 604, more light rays are not satisfied to be emitted from the light emitting surface of the illumination device 601 at the total reflection angle, the illumination device 601 has a higher light emission efficiency, that is, the light utilization rate of the illumination device 601 is higher.

Figure 7:
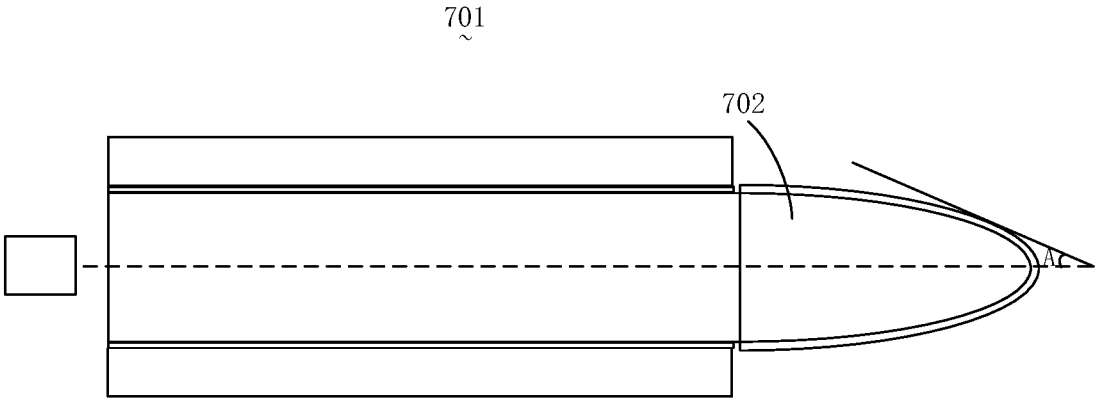
FIG. 7 is a schematic diagram of an illumination device according to a sixth form of the present disclosure.

The present disclosure further proposes an illumination device according to a sixth form, as shown in FIG. 7, a difference between the illumination device 701 of this form and the above-mentioned illumination device 101 lies in that a surface of a second light guiding portion 702 of the light guide (not shown in the drawing) in the illumination device 701 of this form is a parabolic surface, any one tangent line of an intersecting line of the parabolic surface and the cross section passing through the center line of the light guide forms an angle A with the center of the light guide, preferably the angle A is smaller than 45 degrees, and the functional layer is coated on the light emitting surface of the parabolic surface.

Figure 8:
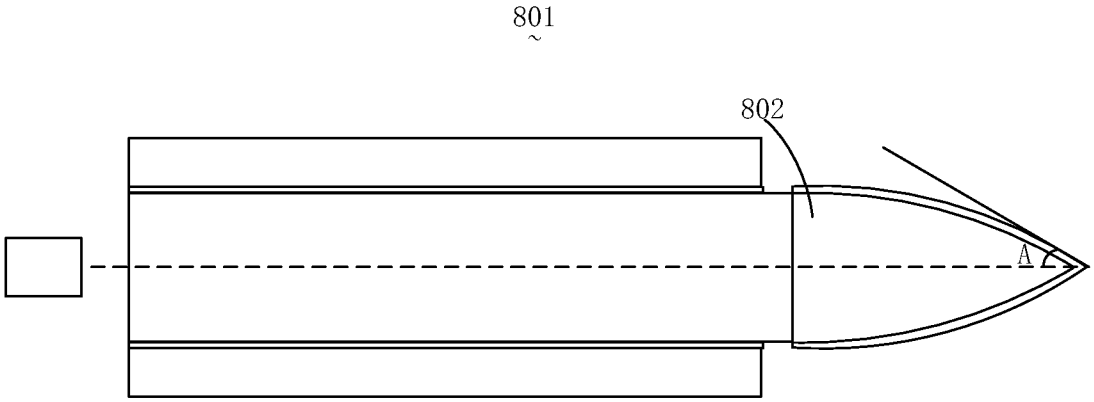
FIG. 8 is a schematic diagram of an illumination device according to a seventh form of the present disclosure.

The present disclosure further proposes an illumination device of a seventh form, as shown in FIG. 8, a difference between the illumination device 801 of this form and the above-mentioned illumination device 101 lies in that a second light guiding portion 802 of the light guide (not shown in the drawing) in the illumination device 801 of this form is a spindle, any one tangent line of an intersecting line of the side surface of the spindle and the cross section passing through the center line of the light guide forms an angle A with the center of the light guide, preferably, the angle A is smaller than 45 degrees, and the functional layer is coated on the light emitting surface of the side surface of the spindle.

Without doubt, in other variations, the light emitting surface of the cone structure of the second light guiding portion of the light guide can also be other curved surfaces.

Figure 9:
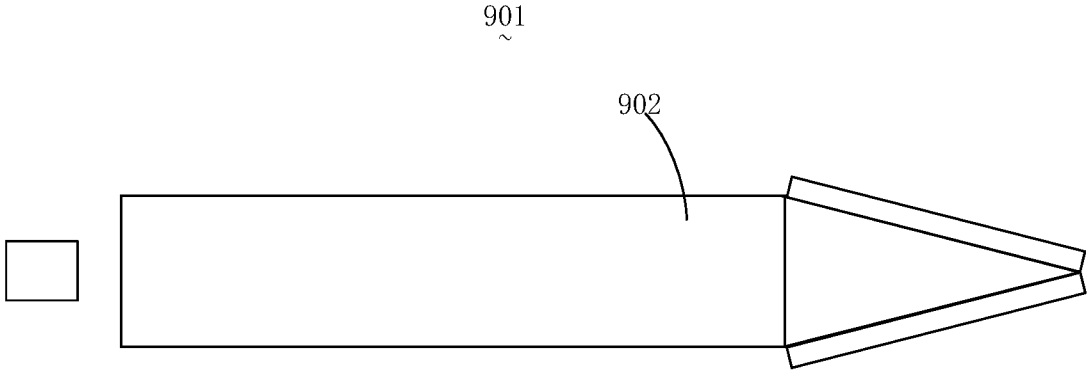
FIG. 9 is a schematic diagram of an illumination device according to an eighth form of the present disclosure.

The present disclosure further proposes an illumination device of an eighth form, as shown in FIG. 9, FIG. 9 is a schematic diagram of the illumination device according to the eighth form of the present disclosure. A difference between the illumination device 901 in this form and the above-mentioned illumination device 101 lies in that, in this form, the illumination device 901 configures a side surface of a first light guiding portion 902 as a polished surface, in order to achieve total internal reflection of the excitation light on the side surface of the first light guiding portion 902, while there is no need to provide a transparent adhesive layer having a refractive index smaller than that of the first light guiding portion 902.

Figure 10:
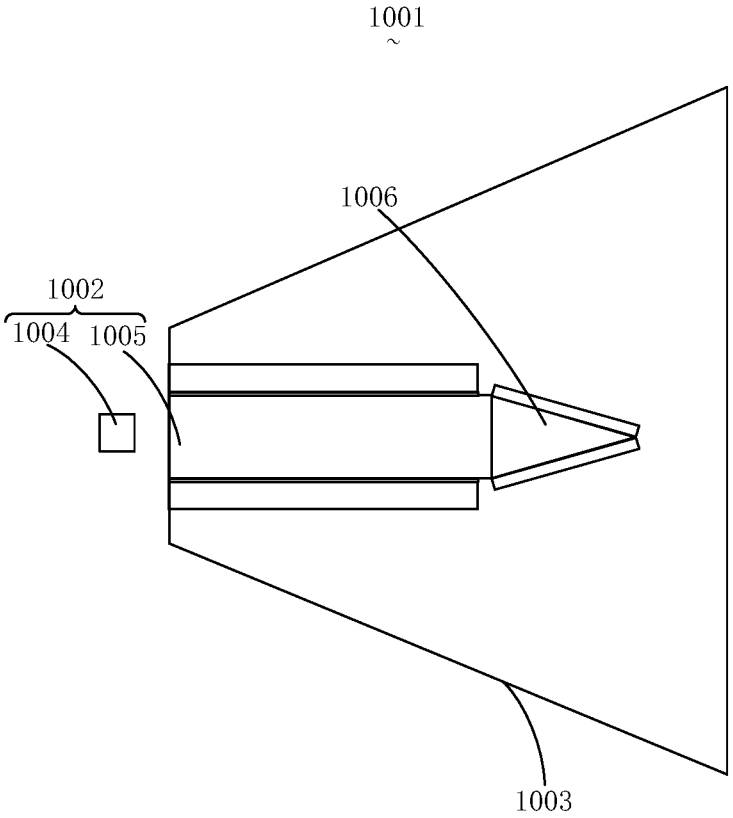
FIG. 10 is a schematic diagram of a vehicle lamp of one form of the present disclosure.

The present disclosure further proposes a vehicle lamp, as shown in FIG. 10, FIG. 10 is a schematic diagram of the lamp according to a form of the present disclosure. The lamp 1001 of this form includes an illumination device 1002 and a reflective bowl 1003, a light source 1004 of the illumination device 1002 is arranged outside the reflective bowl 1003, structures of the illumination device 1002 such as the light guide 1005 are arranged in the reflective bowl 1003, and the light emitting surface of the second light guiding portion 1006 of the light guide 1005 is provided at a focus of the light-emitting bowl. The illumination device 1002 of this form is one illumination device of the above-mentioned variations, which is not repeated herein. Most of the light rays emitted from the light emitting surface of the second light guiding portion 1006 can be emitted after being reflected by the reflective bowl 1003, a remaining small part of the light rays is directly emitted out, to finally form an ideal illumination light pattern, and the vehicle lamp has a higher light utilization rate.

The illumination devices of the present disclosure can also be applied to other types of lamps.

Different from the existing art, the intersecting line of the light emitting surface of the illumination device and the cross section passing through the center of the light guide or any tangent line of the intersecting line in the form of the present disclosure forms an acute angle with the center line of the light guide, and this can reduce the incidence angle of the excitation light on the light emitting surface, to reduce the reflection of the excitation light on the interface between the light emitting surface and the conversion layer, such that more excitation light is emitted to the functional layer and converted into fluorescence or scattered. Therefore, the variation(s) of the present disclosure can improve the light utilization rate.

In addition, the variation of the present disclosure fixes the heat dissipation layer on the side surface of the first light guiding portion through the transparent adhesive layer; and the refractive index of the transparent adhesive layer is smaller than the refractive index of the light guide, so that the excitation light can be totally internally reflected on the side surface of the first light guiding portion, to reduce light loss, and the heat dissipation layer can dissipate heat for the illumination device.

Further, the vehicle lamp of the form of the present disclosure, most of the light rays emitted by the light emitting surface of the illumination device can be reflected by the reflective bowl and emitted to the outside, a small part of the light rays is directly emitted to the outside, which is conducive to forming an ideal illumination light pattern, and the light utilization rate is relatively high. In addition, when the illumination device is applied to the reflective bowl, a defocusing phenomenon is relatively small, and the light utilization rate can be further improved.

The above is only the implementation of the present disclosure and does not limit the scope of the patent of the present disclosure. Any equivalent structure or equivalent process transformation made by using the content of the description and drawings of the present disclosure, or those directly or indirectly used in other related technical fields, are similarly included in the protection scope of patent of the present disclosure.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An illumination device, comprising:

a light source configured to emit excitation light;

a light guide comprising a first light guiding portion and a second light guiding portion, wherein the second light guiding portion comprises a light emitting surface, the excitation light emitted by the light source is coupled into the first light guiding portion and then emitted through the light emitting surface of the second light guiding portion, a cross section of the second light guiding portion perpendicular to a center line of the light guide has an area gradually decreasing along a direction of an optical axis of the light source, and an intersecting line of the light emitting surface of the second light guiding portion and a cross section passing through the center line of the light guide or each of tangent lines of the intersecting line forms an acute angle with the center line of the light guide, wherein the light emitting surface is provided on a portion of a side surface of the second light guiding portion, and the side surface is directly connected to the first light guiding portion; and a functional layer which is coated on the light emitting surface of the second light guiding portion, and configured to perform a wavelength conversion on the excitation light or scatter the excitation light.

2. The illumination device according to claim 1, wherein the intersecting line of the light emitting surface of the second light guiding portion and the cross section passing through the center line of the light guide or each of the tangent lines of the intersecting line forms an angle smaller than 45 degrees with the center line of the light guide.

3. The illumination device according to claim 1, wherein the light emitting surface is provided on the side surface of the second light guiding portion and a portion of a side surface of the first light guiding portion close to the second light guiding portion.

4. The illumination device according to claim 1, wherein the second light guiding portion of the light guide is a cone, and an intersecting line of the side surface of the second light guiding portion and the cross section passing through the center line of the light guide forms an angle smaller than 45 degrees with the center line of the light guide.

5. The illumination device according to claim 1, wherein the second light guiding portion of the light guide is a truncated cone, and an intersecting line of the side surface of the second light guiding portion and the cross section passing through the center line of the light guide forms an angle smaller than 45 degrees with the center line of the light guide.

6. The illumination device according to claim 5, wherein the second light guiding portion comprises a first end surface and a second end surface that are opposite to each other, the first end surface is connected to the first light guiding portion, and the second end surface is provided with a reflective layer.

7. The illumination device according to claim 6, wherein the second end surface of the second light guiding portion comprises a groove, and the reflective layer is disposed in the groove.

8. The illumination device according to claim 1, wherein the side surface of the second light guiding portion is a curved surface, and each of tangent lines of an intersecting line of a side surface of the second light guiding portion and the cross section passing through the center line of the light guide forms an angle smaller than 45 degrees with the center line of the light guide.

9. The illumination device according to claim 1, wherein the light guide further comprises:

a heat dissipation layer disposed on a side surface of the first light guiding portion and configured to dissipate heat of the light guide; and a transparent adhesive layer configured to bond the heat dissipation layer to the side surface of the first light guiding portion in such a manner that the heat of the light guide is conducted to the heat dissipation layer, wherein a refractive index of the transparent adhesive layer is smaller than a refractive index of the light guide.

10. A vehicle lamp comprising an illumination device, wherein the illumination device comprises:

a light source configured to emit excitation light;

a light guide comprising a first light guiding portion and a second light guiding portion, wherein the second light guiding portion comprises a light emitting surface, the excitation light emitted by the light source is coupled into the first light guiding portion and then emitted through the light emitting surface of the second light guiding portion, a cross section of the second light guiding portion perpendicular to a center line of the light guide has an area gradually decreasing along a direction of an optical axis of the light source, and an intersecting line of the light emitting surface of the second light guiding portion and a cross section passing through the center line of the light guide or each of tangent lines of the intersecting line forms an acute angle with the center line of the light guide, wherein the light emitting surface is provided on a portion of a side surface of the second light guiding portion, and the side surface is directly connected to the first light guiding portion; and a functional layer which is coated on the light emitting surface of the second light guiding portion, and configured to perform a wavelength conversion on the excitation light or scatter the excitation light.

11. The vehicle lamp according to claim 10, wherein the intersecting line of the light emitting surface of the second light guiding portion and the cross section passing through the center line of the light guide or each of the tangent lines of the intersecting line forms an angle smaller than 45 degrees with the center line of the light guide.

12. The vehicle lamp according to claim 10, wherein the light emitting surface is provided on the side surface of the second light guiding portion and a portion of a side surface of the first light guiding portion close to the second light guiding portion.

13. The vehicle lamp according to claim 10, wherein the second light guiding portion of the light guide is a cone, and an intersecting line of the side surface of the second light guiding portion and the cross section passing through the center line of the light guide forms an angle smaller than 45 degrees with the center line of the light guide.

14. The vehicle lamp according to claim 10, wherein the second light guiding portion of the light guide is a truncated cone, and an intersecting line of the side surface of the second light guiding portion and the cross section passing through the center line of the light guide forms an angle smaller than 45 degrees with the center line of the light guide.

15. The vehicle lamp according to claim 10, wherein the side surface of the second light guiding portion is a curved surface, and each of tangent lines of an intersecting line of the side surface of the second light guiding portion and the cross section passing through the center line of the light guide forms an angle smaller than 45 degrees with the center line of the light guide.

16. The vehicle lamp according to claim 10, wherein the light guide further comprises:

a heat dissipation layer disposed on a side surface of the first light guiding portion and configured to dissipate heat of the light guide; and a transparent adhesive layer configured to bond the heat dissipation layer to the side surface of the first light guiding portion in such a manner that the heat of the light guide is conducted to the heat dissipation layer, wherein a refractive index of the transparent adhesive layer is smaller than a refractive index of the light guide.

* * * * *